United States Patent [19]

Husain

[11] Patent Number: 4,860,448

[45] Date of Patent: Aug. 29, 1989

[54] TRIANGULAR-SHAPED ORNAMENTAL NAIL CLIPPER WITH SIDE FLAP

[75] Inventor: Abbas Husain, Merchantville, N.J.

[73] Assignee: Ennovation Corporation, Merchantville, N.J.

[21] Appl. No.: 194,031

[22] Filed: May 12, 1988

[51] Int. Cl.[4] ..... A45D 29/00

[52] U.S. Cl. ..... 30/28; 132/75.5

[58] Field of Search ..... 30/28, 124; 132/75.4, 132/75.5; D28/60

[56] References Cited

U.S. PATENT DOCUMENTS

| | | | |
|---|---|---|---|
| 192,590 | 4/1962 | Leopoldi | D28/60 |
| 232,127 | 7/1974 | Rock | D28/60 |
| 264,509 | 5/1982 | Rock | D28/60 |
| 702,516 | 6/1902 | Wilcox | 30/28 X |
| 1,433,936 | 10/1922 | Campbell | 30/28 |
| 3,093,147 | 6/1963 | Bassett | 132/75.5 |

*Primary Examiner*—Douglas D. Watts

*Attorney, Agent, or Firm*—Robert D. Thompson

[57] ABSTRACT

Provided is a triangular-shaped clipper for a nail made of a pair of cooperative jaws having a plurality of connected sharpened concave or convex edges which register with each other by activation of a triangular-shaped lever member, the jaws having a normal tendency to separate, the lever member being mounted hingedly and turnably onto a means connecting said jaws for directing a force from said lever member to close said jaws, each of said jaws having an edge which exhibits a design comprised of at least three connected convex or concave arches with a side flap or extension of one side of the lower jaw such that the extension exhibits a curved shape which extends a distance and curves such that it wraps the edge of the finger or toe to hold or register the place or position of the cutting edges relative to the nail to maintain the pattern produced by the ornamental cutting edges on the nail at the same relative position on all nails cut.

3 Claims, 5 Drawing Sheets

TRIANGULAR-SHAPED ORNAMENTAL NAIL CLIPPER WITH SIDE FLAP

BACKGROUND OF THE INVENTION

This invention relates to a triangular-shaped nail clipper with ornamental cutting edges and a side flap which, in combination, produce an apparatus with a body of relatively short length compared to conventional nail clippers which, with light finger pressure applied to the triangular-shaped activating lever moves the jaws of the nail clipper together to cut the nail and produce an ornamental design on the nail while the side flap enables the user to maintain the same relative position of the design on multiple nails. The invention has multiple advantages. It can be produced with a relatively short body length with its triangular shape enabling it to achieve increased spring-back properties due to the width of the base of the apparatus in comparison to the width of the jaws. An ease of operation comparable to the operation of a conventional nail clipper is acheived even using the short body design through the use of the triangular-shaped activating lever which enables the user to exert an activating force across the entire width of the activating lever using the thumb or forefinger. An important element of the invention is the concept of enabling the user to apply a force across the width of the handle which force is concentrated at the relatively narrow jaws of the apparatus producing an easy cut of even a very thick and tough nail.

In certain embodiments the invention has the added advantage of being capable of producing a multi-arch design on the nail which is cut. The use of the side flap enables the user to apply the nail clipper and produce the ornamental design at the same relative position on each nail that is cut. This side flap extends around the tip of the finger and down the side of the finger enabling the user to easily maintain the same relative position of the ornamental design on each nail which is cut.

CROSS-REFERENCES TO RELATED APPLICATIONS

A nail clipper with ornamental cutting edge is the subject of an application by Inventor Abbas Husain now pending before the Board of Patent Appeals and Interferences, Ser. No. 06/848,744 (Examiner Fridie).

BRIEF SUMMARY OF THE INVENTION

The present invention provide an apparatus for producing an ornamental design or cut on fingernails and toenails. The apparatus includes a triangular-shaped body with the cutting jaws located at one vertex of the triangular shape. The body consists of two oppositely disposed triangular shaped members which are attached along the length of the base of the triangular shape opposite to the jaws. The two members of the body are shaped such that the two jaws, each jaw located at the vertex opposite the attached base of the triangular member, are normally apart. The apparatus also includes a triangular-shaped activating lever attached to a post which extends vertically through the body members centered laterally at the mid-point of the jaws and longitudinally in the proximity of the jaws such that the distance from the post to the base of the body exceeds the distance from the post to the jaws by a multiple of at least three. The post is attached to the lower triangular member of the body such that it will pivot or turn in the lower member. The post extends through an opening in the upper member and is attached above the upper member to the triangular-shaped activating lever. The triangular-shaped activating lever is attached to the post such that it can turn on the post in a 360-degree arc in relation to the members of the triangular-shaped body. The activating lever has a shape across the horizontal plane such that when the activating lever is turned to the open position for use, it becomes a lever with the fulcrum applied at and across the top triangular-shaped body member and against the vertical axis of the post. The force applied down and across the base of the triangular-shaped activating lever forces the ornamentally-shaped jaws together cutting the nail and producing an ornamental shape.

The jaws of the apparatus consist of at least three concave or convex arches which, when forced together by the action of the activating lever on the upper body member, produce an ornamental cut on the nail to correspond to the shape of the jaws. The side flap is attached to either or both sides of the lower jaw. This side flap extends around the tip of the member whose nail is being cut to enable the user to maintain the same relative position of the nail cut on each member.

BRIEF DESCRIPTION OF SEVERAL VIEWS OF THE DRAWINGS

A more complete understanding of the invention and its advantages will be apparent from the detailed description taken in conjunction with the accompanying drawings in which.

DETAILED DESCRIPTION

Figure 1:
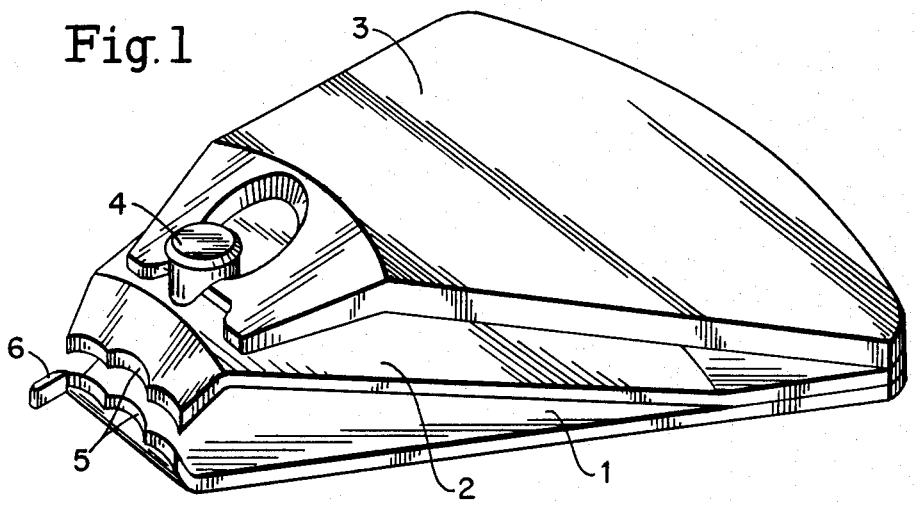
FIG. 1 is top perspective view of the apparatus.
Figure 2:
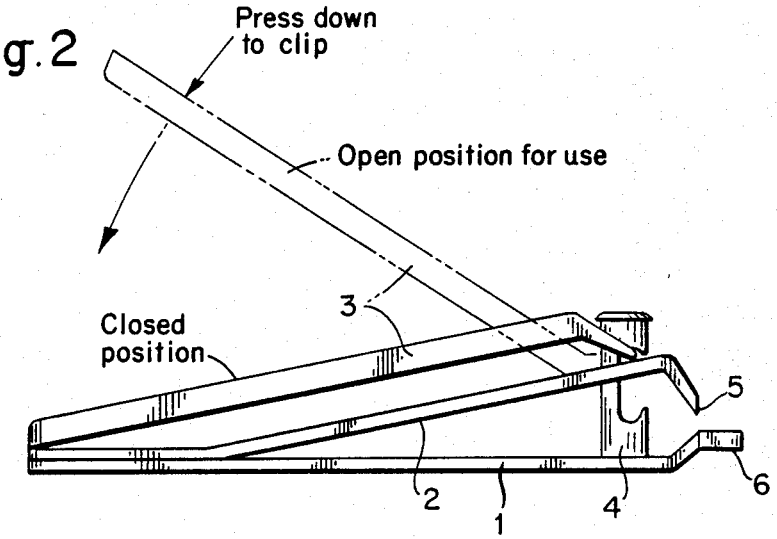
FIG. 2 is a right side elevtion view of the apparatus.
Figure 3:
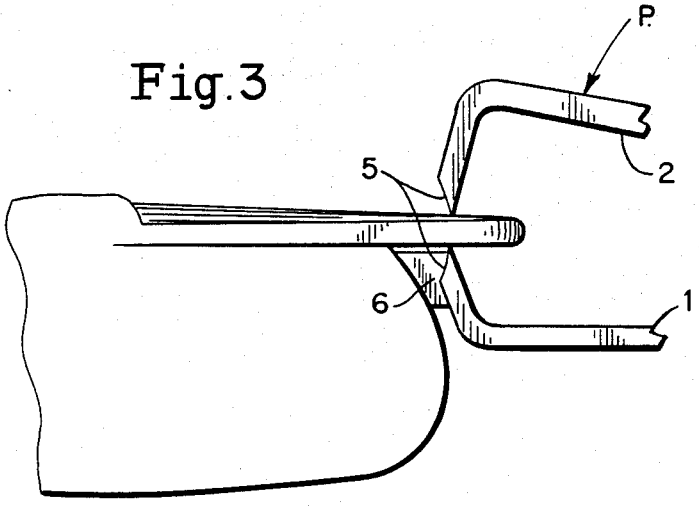
FIG. 3 is a left side elevation view showing the application of the jaws and side flap to a nail.
Figure 4:
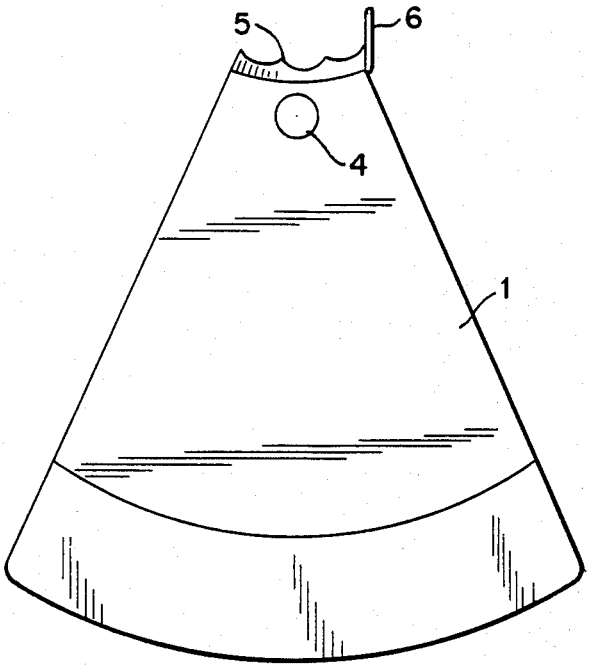
FIG. 4 is a bottom elevation view of the baseplate member.
Figure 5:
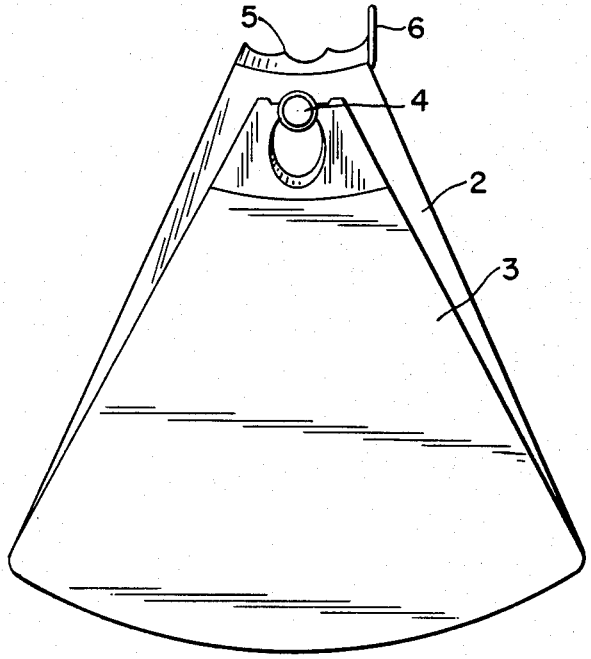
FIG. 5 is a top elevation view of the activating lever turned in its storage position on the upper body member.
Figure 6:
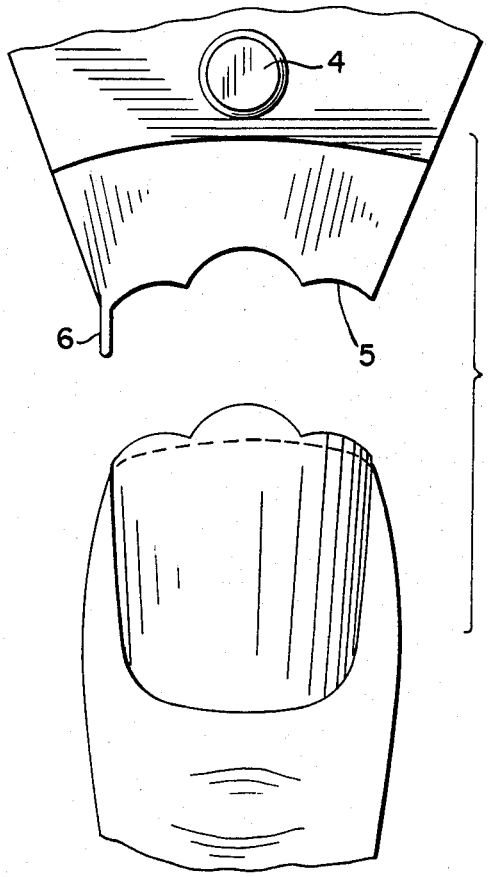
FIG. 6 is a partial top view of the jaws, side flap and a nail cut to ornamental shape.
Figure 7:
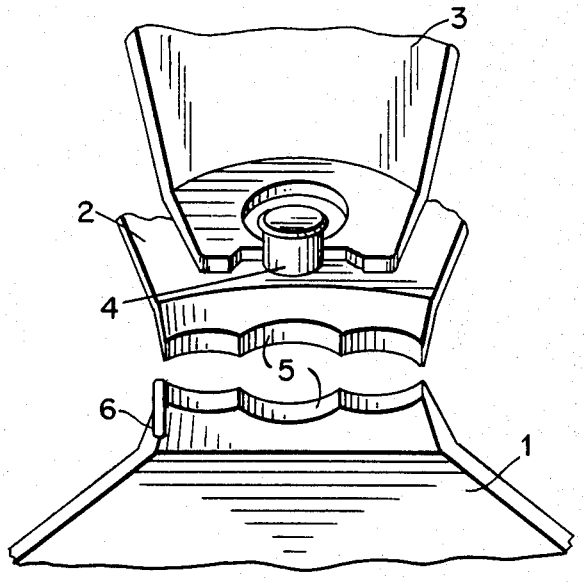
FIG. 7 is a front view of the jaws of the apparatus.

Referring initially to FIGS. 1 and 2, the apparatus includes a lower body member 1, an upper body member 2, an activating lever 3, a post 4, jaws 5, and a side flap or side flaps 6. The lower body member 1 and the upper body member 2 are triangular in shape and attached along the side or base of the triangular shape opposite to the vertex where the jaws 5 are located. The lower body member 1 and the upper body member 2 may be formed of metal or some other material with spring or memory properties. The upper body member 2 is bent or curved on the horizontal plane such that the jaw located at the vertex opposite the base is separated from the jaw at the vertex of the lower body member. The post 4 extends vertically through openings in the upper body member 2 and the lower body member 1 with means operative to attach the post 4 to the lower body member 1 such that the post will be retained in its opening through the lower body 1 but is free to rotate around its center vertical axis in its hole through the lower body member 1 and the upper body member 2. The activating lever 3 is attached to the post 4 and shaped such that when it is in the closed position it fits congruent with the upper body member 2 and parallel along the plane formed by the upper body member 2 with the horizon. While in the open position for use, the activating lever is shaped such that when turned to that open position from the closed position on the post 4, the activating lever 3 forms a lever against the upper body member 2 with a downward force and against the post 4 with an upward force along the vertical axis of the post 4 when a force is applied at the end of the activating lever 3 opposite to the end secured by the post 4. The action of the activating lever 3 against the post 4 and the upper body member 2 forces the jaw 5 of the upper body member against the jaw 5 of the lower body member 1 bringing the two jaws together with sufficient force to cut a fingernail or toenail into the ornamental shape formed by the jaw 5. The side flap 6 attached to one or both sides of the lower body member 1 extends around the tip of the finger or toe and down its side to enable the user of the apparatus to maintain the same relative position of the ornamental design on each nail cut. The application of the apparatus to a nail with the use of the side flap is shown in FIG. 3.

Many modifications can be made in the exemplary structure described above without exceeding the scope of the present invention. While certain embodiments of the present invention have been described in detail herein and shown in the accompanying drawings, it is obvious that minor changes may be made in the form and construction of the invention without departing from the material spirit thereof.

What is claimed is:

1. A nail clipper comprising a pair of superimposed triangular-shaped body members and a triangular-shaped activating lever, said body members being of spring material connected at their bases and biased apart to provide yieldable spacing between cooperating cutter jaws located at the vertices of said body members opposite to the connected bases, said activating lever mounted pivotably on a post located adjacent to the cutter jaws, said post being connected at its bottom to the lower body member and extending up and through an opening in the upper body member.

2. A nail clipper comprising a pair of superimposed triangular-shaped body members having cooperating cutter jaws located at the vertices of the triangular-shaped body members, means fastening the bases of said body members, said body members being of spring material and biased apart to provide yieldable spacing between said cutter jaws, said cutter jaws exhibiting a shape of at least three connected concave or convex arches and further comprising a flap mounted on or extending from either or both sides of the lower body member jaw, said flap having a shape contoured to extend around the top of the finger or toe and down its side to maintain the relative position of the design on the nail.

3. A nail clipper comprising a pair of superimposed body members having cooperating cutter jaws located at one end of the body members, means fastening the opposite end of said body members, said body members being of spring material and biased apart to provide yieldable spacing between said cutter jaws, said cutter edges comprising a means for cutting a design in a nail of at least three connected concave or convex arches with a flap control attached to the side or sides of the lower cutting jaw, said flap control extending around the tip and down the side of the finger or toe on which the nail is being cut to maintain the same relative position of the ornamental design produced on each nail cut.

* * * * *